United States Patent [19]

Epes

[11] 4,184,621

[45] Jan. 22, 1980

[54] BUILDING PRESS

[76] Inventor: Archie C. Epes, 1705 Audubon Pl., Shreveport, La. 71105

[21] Appl. No.: 889,831

[22] Filed: Mar. 24, 1978

Related U.S. Application Data

[63] Continuation-in-part of Ser. No. 687,022, May 17, 1976, Pat. No. 4,081,120.

[51] Int. Cl.[2] ..... B27F 7/02

[52] U.S. Cl. ..... 227/26; 52/749; 52/DIG. 6; 100/269 A; 100/DIG. 13; 227/152

[58] Field of Search ..... 52/749, 750, DIG. 6; 100/269 A, DIG. 13; 227/16, 18, 26, 30, 80, 95, 113, 152, 135, 136

[56] References Cited

U.S. PATENT DOCUMENTS

| | | | |
|---|---|---|---|
| 1,127,838 | 2/1915 | Willers | 227/147 |
| 1,312,615 | 8/1919 | Cooper | 100/269 A |
| 2,540,106 | 2/1951 | Eichelberger | 227/152 |
| 2,560,902 | 7/1951 | Smith | 100/269 A |
| 3,294,303 | 12/1966 | Anstett | 227/95 |
| 3,494,645 | 2/1970 | Jureit | 85/13 X |
| 3,589,957 | 6/1971 | Cohn | 227/18 X |
| 3,626,818 | 12/1971 | Anson | 93/37 R |
| 3,708,062 | 1/1973 | Feldheim et al. | 227/18 X |
| 3,765,322 | 10/1973 | Weyer | 100/269 A X |
| 3,913,816 | 10/1975 | Jureit et al. | 227/95 |

FOREIGN PATENT DOCUMENTS

| | | | |
|---|---|---|---|
| 929932 | 1/1948 | France | 52/DIG. 6 |
| 1474537 | 3/1967 | France | 85/13 |

*Primary Examiner*—Paul A. Bell

[57] ABSTRACT

A building press for joining building components including building trusses, which consists of a frame having a fixed portion and at least one movable hammer, which frame is designed to receive a predetermined number of building components and to join the components with selected fasteners by means of fluid pressure such as air. The frame is equipped with at least one expandable conduit or several fluid actuated cylinders positioned between a fixed member of the frame and the hammer or hammers, and in a preferred embodiment, a multiplicity of fasteners are magnetically positioned on segments of the hammer to be driven into the building components. When a fluid such as air, oil or water is forced through the conduit, the conduit expands and the hammer or hammers force the nail plates into the building components to securely join the components in a selected configuration. In the alternative, the components may be joined by applying hydraulic pressure on several hydraulic cylinders by means of air, steam, oil or other suitable fluid.

18 Claims, 33 Drawing Figures

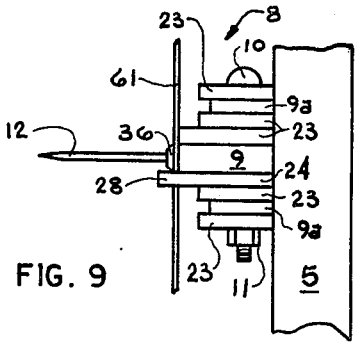
FIG. 9
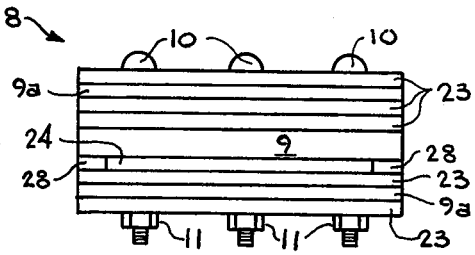
FIG. 10
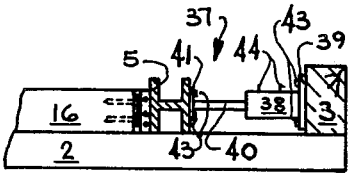
FIG. 12
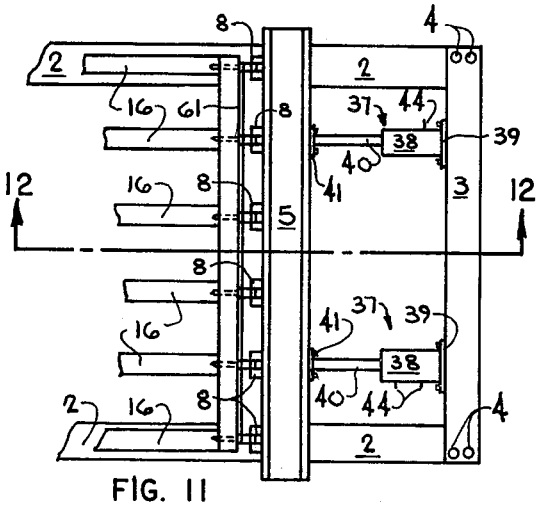
FIG. 11
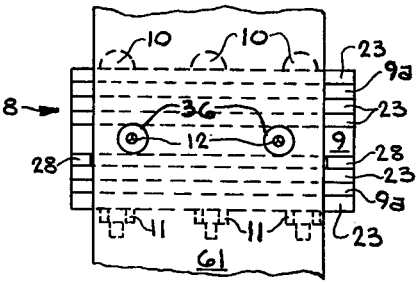
FIG. 13
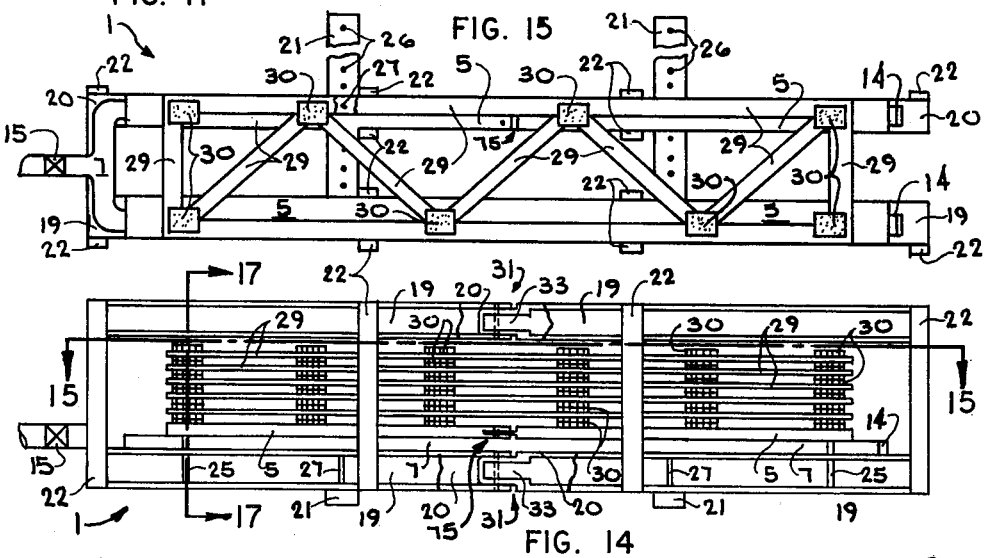
FIG. 14
FIG. 15
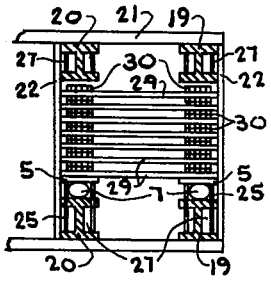
FIG. 17
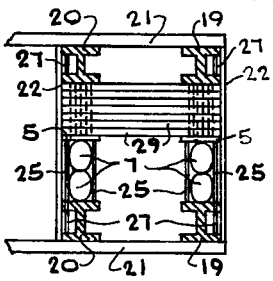
FIG. 18
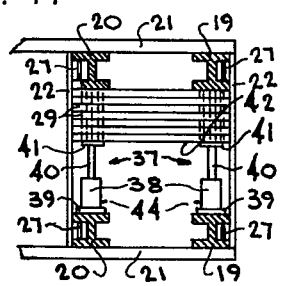
FIG. 19
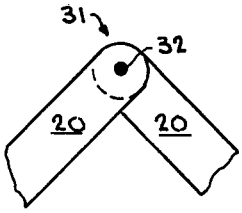
FIG. 16

BUILDING PRESS

CROSS REFERENCE TO RELATED APPLICATION

This application is a continuation-in-part of my copending application Ser. No. 687,022, filed May 17, 1976, entitled "Building Press" now U.S. Pat. No. 4,081,120.

BACKGROUND OF THE INVENTION

1. Field of the Invention

This invention relates to a new and improved building press or jig whereby the precut parts for the manufacture of building components such as wall panels and roof and girder truss members, can be joined simultaneously by application of fluid pressure such as air, through several hydraulic cylinders or through one or more expandable hoses. The building press consists of a fixed frame having at least one movable hammer, between which frame and hammer is placed one or more fluid conduits or hoses, or several air, steam or hydraulic cylinders. Nails, nail plates or other suitable fasteners can then be positioned in selected locations on the hammer or hammers, the hose pressured with fluid (preferably air) or the hydraulic cylinders activated, and the fasteners thereby driven into the building components at selected locations. For example, an entire wall section of selected length, or the interior or exterior wall section for a completed building, as well as flat or girder truss members or roof trusses may be assembled in the frame or jig and fastened together simultaneously and automatically, if desired, by the turn of a lever causing application of fluid pressure and utilization of the building press of this invention. Pitched roof and girder trusses may also be manufactured singularly, or several trusses of the same design built simultaneously with only one application of the press. Various types of fasteners, including nail strips and sprocket driven nail bands are utilized to join the building components.

DESCRIPTION OF THE PRIOR ART

Heretofore, the primary method of joining building components in the assembly of wall and roof sections and trusses has been by nailing, with each joint nailed separately by hand. This procedure has been modified to some extent in recent years by placing the component parts in a jig or tight frame, and nailing the parts together with hammer and nail or with pneumatic guns. Some housing components such as roof trusses are manufactured by pressing flat steel plates with attached protrusions or teeth into the wood where the material is to be joined, either by using fluid activated cylinders or truss rollers. Wall sections are typically built by using pneumatic guns positioned at each joint and the nails forced into the wood, either one at a time, or simultaneously using a group of pneumatic guns, each of which is positioned at a specific joint. In the case of truss construction, where steel plates are used, the nailing must still be accomplished for the most part by hand, or with complicated truss rollers or other equipment designed to place considerable pressure at specifically designated points on the component parts of the truss or other member to achieve a tight fit. Pneumatic guns are constantly breaking down or running out of fasteners, which slows production, and truss rollers are slow and frequently produce trusses of poor quality. Accordingly, such techniques are characterized by high expense and expenditure of a large amount of time, whether the structure being built is assembled piecemeal and nailed by a carpenter, fastened by use of pneumatic guns, or by use of "gang" nail procedures. In the former case, the carpenter must nail each joint individually, by hand, and each piece must be cut separately to fit, thereby resulting in a large expenditure of time and money with no real assurance that the material will be fitted to a high tolerance.

In recent years there has developed a renewed interest in developing wooden trusses in both commercial and home building because of the rapidly escalating cost of steel. It has been found that wooden trusses are highly reliable, relatively inexpensive, and can be quickly and easily fabricated for a wide variety of building configurations. As heretofore pointed out, speed and quality are necessary ingredients in truss production operations; accordingly, the equipment used to manufacture the trusses must be highly reliable and capable of assembling trusses rapidly and efficiently.

Accordingly, it is an object of this invention to provide an improved mechanism for constructing wall panels and truss members and other construction component assemblies whereby multiple joints must be joined together.

Another object of this invention is to provide a building press for joining construction materials for houses, buildings and other structures, which is simple in design, inexpensive to set up, and may be specifically designed for joining substantially all component parts in a desired fabrication in a single operation.

A still further object of the invention is to provide a new and improved building press or jig whereby the component parts of a structure such as a truss section may be fabricated by means of water, air or other fluid pressure applied through a conduit or hose or several air, steam or hydraulic cylinders in the jig.

Yet another object of the invention is to provide a new and improved apparatus for constructing the component parts of a structure which includes the use of a frame having a fixed and movable portion and applying fluid pressure through a hose or several air, steam or hydraulic cylinders located between the fixed and movable portions of the frame to drive nails or other fasteners into the component parts in the fabricating process.

Another object of the invention is to provide a new and improved building press which utilizes movable hammers pressured by expanding hoses or fluid actuated cylinders to drive fasteners carried on belts into the respective joints of the truss or wall section under construction in fabricating multiple truss or wall section members in a single operation.

SUMMARY OF THE INVENTION

These and other objects of the invention are provided in a building press for assembling component parts of a structure, including truss members, which includes the following elements:

1. A frame or jig having a fixed portion and at least one movable portion or hammer;

2. At least one fluid conduit or several fluid pressure actuated cylinders located between the fixed portion of the frame and the hammer or hammers, and adapted to receive a pressurized fluid at selected time intervals; and 3. Means for positioning and carrying nails or other suitable fasteners in cooperation with the hammer or hammers whereby when air, oil, water or other fluid pressure is applied to the conduit or through operation of an air or hydraulic cylinder, the hammer or hammers exert pressure on the nails or alternative fasteners, and simultaneously forces them into the component building parts to be joined.

BRIEF DESCRIPTION OF THE DRAWINGS

The invention will be better understood in view of the following description presented with reference to the accompanying drawings.

FIG. 9 is a top elevation of a preferred magnetic nail positioner for magnetic attachment to the hammer or hammers of the building press;

FIG. 10 is a front elevation of the magnetic nail positioner illustrated in FIG. 9;

FIG. 11 is a top view, partially in section, of the building press illustrated in FIG. 1 showing the hammer, fixed nail band and fastener configuration after pressuring of the hammer by fluid activation of a pair of fluid activated cylinders;

FIG. 12 is a sectional view taken along lines 12—12 of the building press illustrated in FIG. 11, more particularly illustrating the joining of the building components by operation of fluid activated cylinders;

FIG. 13 is a front elevation, partially in section, of the magnetic nail positioner illustrated in FIG. 10 with a fixed nail band in position and two nails in functional position over a magnet;

FIG. 14 is a front elevation of an alternative embodiment of the building press of this invention, more particularly illustrating a configuration suitable for multiple truss construction;

FIG. 15 is a top sectional view of the press illustrated in FIG. 14 and taken along lines 15—15 thereof;

FIG. 16 is a top view, partially in section, of the frame swivel which facilitates construction of both pitched roof trusses and flat, or girder trusses.

FIG. 17 is a sectional view taken along lines 17—17 in FIG. 14 and more particularly illustrating the positioning of truss components in the press prior to applying pressure to a single hose;

FIG. 18 is a sectional view also taken along lines 17—17 of FIG. 14 and illustrating an alternative embodiment of pressuring a pair of hoses to fabricate multiple trusses in the press;

FIG. 19 is a sectional view taken along lines 17—17 of FIG. 14 and illustrating still another preferred embodiment of pressuring the truss components by application of fluid actuated cylinders;

DESCRIPTION OF THE PREFERRED EMBODIMENTS

Figure 1:
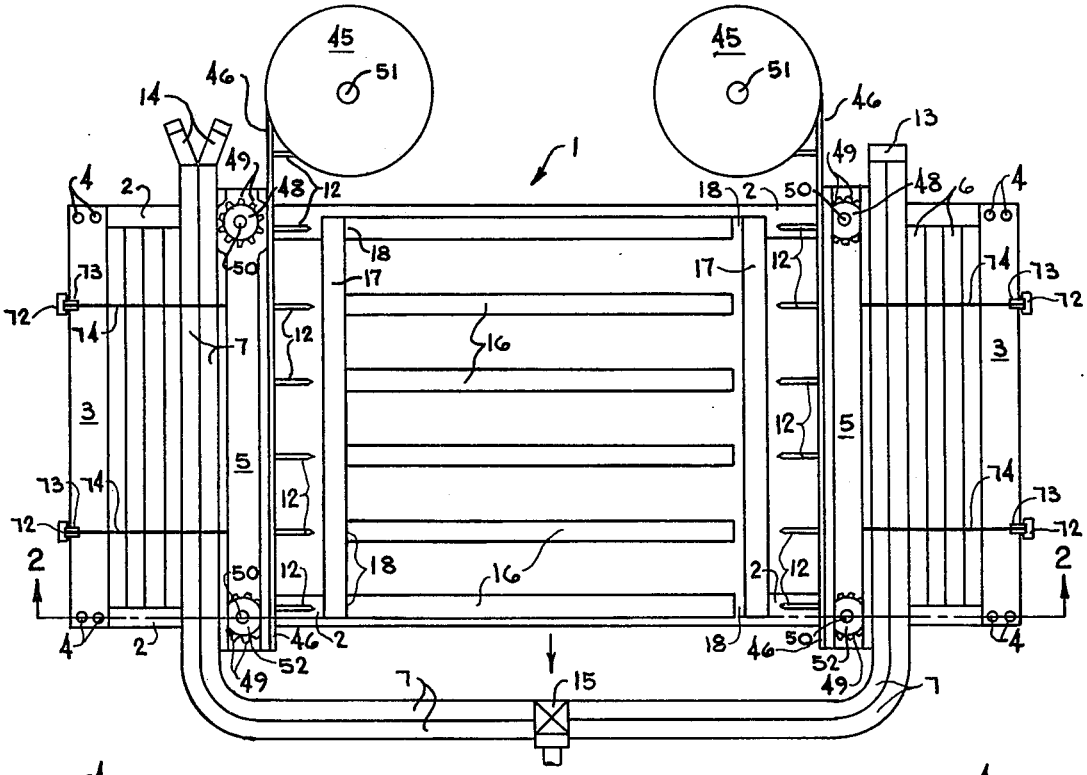
FIG. 1 of the drawings is a top view of a typical building press of this invention illustrating the press in driving configuration with fasteners in position and ready for fluid activation of the hammers by pressuring hoses.
Figure 2:
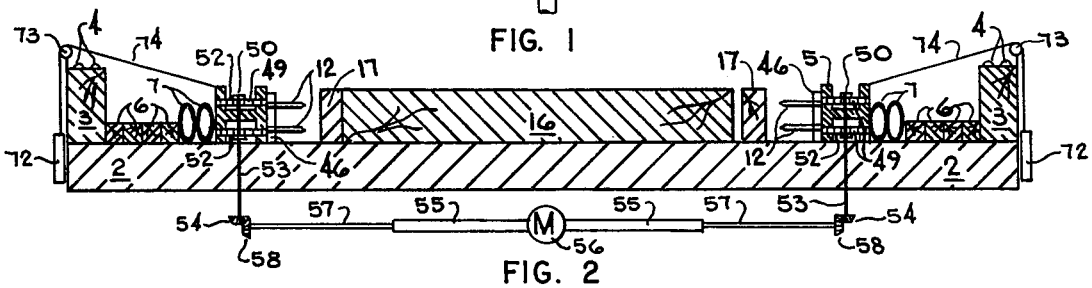
FIG. 2 is a sectional view taken along lines 2—2 of the building press illustrated in FIG. 1.
Figure 6:
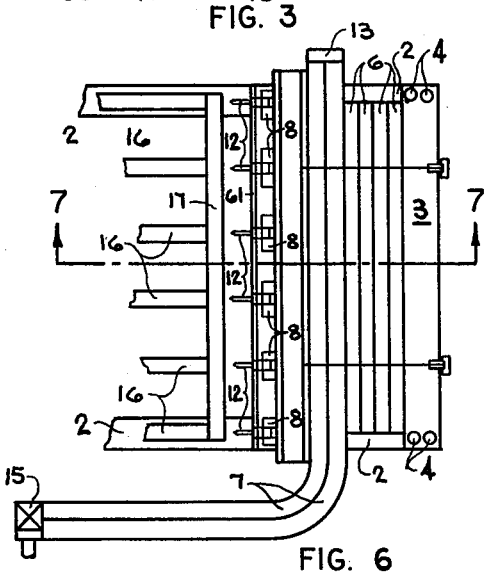
FIG. 6 is a top view, partially in section, of the building press illustrated in FIGS. 1 and 2 of the drawings, more particularly illustrating a preferred technique for positioning the nail band or strip illustrated in FIGS. 4 and 5.
Figure 7:
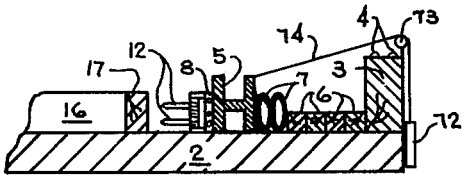
FIG. 7 of the drawings is a front sectional view taken along lines 7—7 of the embodiment illustrated in FIG. 6, more particularly illustrating the building press in configuration using the nail band and magnet combination to position fasteners prior to activation of the press.

Referring now to FIGS. 1, 2 and 6 of the drawings, the building press of this invention, generally illustrated by reference numeral 1, is shown in open configuration, with frame 2, carrying frame stop 3 by means of frame stop bolts 4, and hammers 5, spaced from frame stop 3 by at least one optional filler 6 and hoses 7. Nail positioners 8, (more particularly illustrated in FIGS. 9 and 10) may be fitted with forward magnets 9 and rear magnets 9A, spaced by magnet plates 23, which are in turn joined by nail positioner bolts 10 and nail positioner nuts 11. Nails 12 are illustrated in position on sprocket nail band 46, more particularly illustrated in FIG. 3, and are placed in position to join horizontal building components 16 and vertical building components 17 at building component joints 18 by means of drive sprockets 52 and idler sprockets 48. A pair of drive sprockets 52 and mounted on each hammber 5 by means of drive sprocket shaft 53, and a pair of idler sprockets 48 are similarly mounted on the opposite end of each hammer 5 by means of an idler sprocket shaft (not illustrated). Drive sprocket shafts 53 carry drive bevel gears 54, which in turn cooperate with drive motor bevel gears 58, mounted on drive shafts 57, which telescope into drive shafts 55, which are in turn driven by drive motor 56, as illustrated in FIG. 2. Operation of drive motor 56 causes drive sprockets 52 to rotate and draw a length of sprocket nail band 46 from nail band drums 45 to position nails 12 on hammers 5. Nail band drums 45 are rotatably carried by nail band drum shafts 51, as illustrated in FIG. 1. Referring again to FIG. 2 of the drawings, hoses 7 are shown in collapsed configuration between hammer 5 and fillers 6. It will be appreciated that hoses 7 may be replaced with several air, steam or hydraulic cylinders attached to filler 6, as desired, to serve the same function as hoses 7, as illustrated in FIGS. 11 and 12. Nails 12 are sufficiently spaced from vertical building components 17 to allow both vertical building components 17 and horizontal building components 16 to be appropriately placed in frame 2 and to permit proper positioning of sprocket nail band 46 on hammer 5 prior to the fastening operation. Fillers 6 are designed to compensate for variance in the size of horizontal building components 16 and vertical building components 17.

Figure 5:
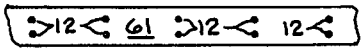
FIG. 5 is a top view of the nail band or strip illustrated in FIG. 4 of the drawings.
Figure 8:
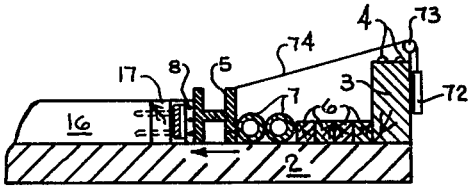
FIG. 8 is a front sectional view also taken along lines 7—7 of the building press illustrated in FIG. 6, illustrating the expanding of the hoses by application of fluid pressure to drive the fasteners into the building components.

Referring now to FIGS. 5–8 of the drawings, an alternative means for placing nails 12 on hammers 5 is disclosed, in the form of a fixed nail band 61. This band may be constructed of a suitable plastic, metal or fabric, and nails 12 positioned thereon as hereinafter described. Nail band 61 is preferably constructed in a length corresponding to the length of hammers 5, or to the length of the component to be manufactured, with nails 12 spaced according to the particular building member to be constructed. Accordingly, if it is desired to construct a wall member having studs located on 16 inch centers, nails 12 would be positioned on fixed nail band 61 also on 16 inch centers as illustrated in FIG. 5. While it will be appreciated that a fixed nail band 61 can be placed on each hammer 5 and held or clamped during the fabrication step, it is preferred to place a nail positioner 8, illustrated in FIGS. 9 and 10 of the drawings, at each point on hammers 5 where nails are to be driven into the workstock. When this is accomplished, a fixed nail band 61 can be positioned on nail positioners 8 as illustrated in FIGS. 6, 7, 9 and 13, with each forward magnet 9 attracting a respective one of nail heads 36 of nails 12 and rear magnets 9A holding the nail positioners 8 on hammers 5 in the desired spacing. Accordingly, it will be appreciated that when hose clamps 13 are sealed and pressure release fittings 14, illustrated in FIG. 1, are closed, and when air, water, oil, or other suitable fluid is allowed to enter hoses 7 by operation of fluid inlet valve 15, hoses 7 will expand as illustrated in FIG. 8 and force hammer 5 to move in the direction of the arrow. This movement of hammer 5 causes nails 12 to be forced into building component joints 18, thereby joining horizontal building components 16 and vertical building components 17 at building component joints 18. Pressure release fittings 14 can then be activated, the fluid drained from hoses 7, hammer 5 retracted as the pressure is released from hoses 7, and the completed building section removed from the frame. Hammers 5 may be manually retracted, or at least one simple gravity pull characterized by hammer weights 72, hammer weight pulleys 73, and hammer weight lines 74 may be used to retract hammers 5, as illustrated in FIGS. 1, 2 and 6–8 of the drawings. Additional components can then be placed in the frame, more nails or alternative fastening means placed on magnets 9 or on hammers 5 by means of sprocket nail band 46, and the procedure outlined above repeated.

It will be appreciated that the same process takes place when hoses 7 are replaced by several air, steam or hydraulic cylinders, as illustrated in FIGS. 11 and 12 of the drawings. Pressure cylinders 37 are fitted with pressure fittings 44, and each cylinder base 39 is attached to the respective ones of frame stop 3 of building press 1. Cylinder rams 40 are carried by cylinder bodies 38, and one end of each of cylinder rams 40 is attached to hammers 5. Appropriate fluid pressure conduit (not illustrated) is then connected to each of the pressure fittings 44, and a suitable source of pressure connected to the conduit according to the knowledge of those skilled in the art. Activation of the pressure source therefore causes the hammers 5 to drive nails 12 into the workstock.

Referring again to FIGS. 9 and 10 of the drawings, it will be appreciated that nail positioner 8 is composed of forward magnets 9 and rear magnets 9A, which are spaced by magnet plates 23 and held in position by nail positioner bolts 10 and nail positioner nuts 11. As heretofore described, forward magnets 9 serve to hold nails 12 onto nail positioner 8, and rear magnets 9A hold nail positioner 8 onto hammer 5. Furthermore, a support magnet plate 24 is provided between forward magnet 9 and one of the magnet plates 23, which support magnet plate 24 is characterized by a projecting support magnet plate lip 28 which serves to help position and support a sprocket nail band 46 and fixed nail band 61, or other nail strips or bands selected for use in the building press of this invention.

It will be further appreciated that in addition to nails, other suitable fasteners such as screws, rivets, staples and the like may be utilized in the invention to join the building components as desired. Multiple joints can be joined, limited only by the size of the particular section being fabricated, and several presses may be arranged for simultaneous operation to provide capability for assembling the component parts for an entire house, mobile home, crate, box or the like, as desired. By use of a magnetic fastener positioner such as nail positioner 8, the press configuration can be changed in a matter of seconds from wall sections, for example, with studs on 16" centers, to sections having studs on 24" centers, or to change the location of rough openings for doors, windows and the like, as desired.

Figure 33:
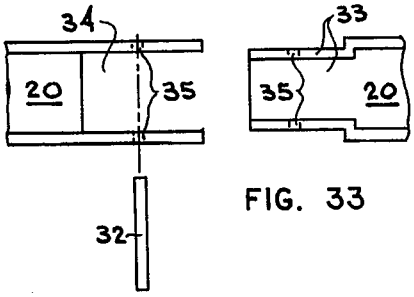
FIG. 33 is a front elevation, partially in section, of the frame swivel illustrated in FIG. 14 of the drawings.

Referring now to FIGS. 14 through 19 of the drawings, in another preferred embodiment of the invention there is provided a building press 1 which is adapted to receive multiple truss members 29 for the construction of multiple trusses by forcing a plurality of nail plates 30 into truss members 29 by application of fluid or fluid actuated cylinder pressure. In this embodiment of the invention building press 1 is characterized by front frame members 19 and rear frame members 20 braced in a rectangular shape by application of braces 22. Building press 1 can be adapted to accommodate truss members 29 of varying size by adjustment of adjusting members 21, which span both the bottom and the top of building press 1, as illustrated in FIG. 15 of the drawings. Adjusting members 21 are fitted with adjusting holes 26, which register with corresponding holes in the bottom and top of front frame members 19 and rear frame members 20 and adjusting pins 27 register with these adjusting holes 26 to facilitate fabrication of a truss of selected dimensions. Referring now to FIGS. 14 and 16 of the drawings, it will be appreciated that rear frame members 20 of building press 1 are made adjustable by frame swivels 31, which permit the construction of a roof truss having a desired roof pitch. The swivels are not needed unless the press is used to manufacture trusses requiring a pitch. It will be further appreciated that the hammer 5 which serves rear frame members 20 must also be fitted with a similar frame swivel 75, or separate hammers 5 must be used for each span of rear frame members 20 in order to adapt building press 1 to a pitched roof truss construction. In a preferred embodiment of the invention, frame swivel 31 is constructed as illustrated in FIGS. 16 and 33, with swivel pin 32 acting as a pivoting member and registering in pin apertures 35, which are formed in swivel plate 33 and in the mating legs of rear frame members 20 which form swivel slot 34, as illustrated. As further illustrated in FIG. 19 of the drawings, it will be appreciated that under circumstances where it is desired to use pressure cylinders 37 as the truss constructing force, pressure cylinders 37 are preferably disposed between front frame members 19 and rear frame members 20 and between a cylinder ram plate spanner 42, in order to facilitate uniform application of pressure to truss members 29. Cylinder rams 40 of pressure cylinders 37 are typically attached to cylinder ram plate spanner 42 by means of a cylinder ram plate 41 and cylinder mount bolts 43, more particularly illustrated in FIG. 12 of the drawings.

Figure 20:
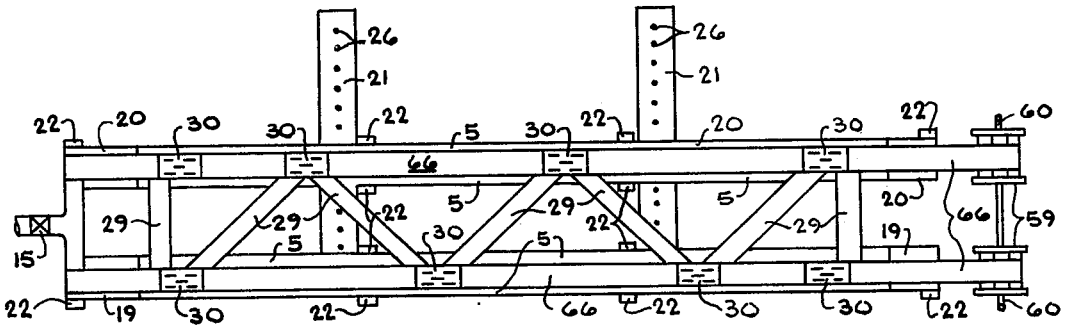
FIG. 20 is a top sectional view of the building press illustrated in FIG. 14 and taken along lines 15—15, more particularly illustrating a preferred technique of using plate bands to locate nail plates in proper position between truss components.
Figure 21:
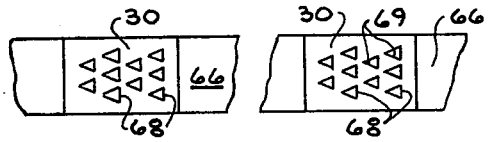
FIGS. 21 and 22 illustrate a preferred plate band for use with the truss constructing building press illustrated in FIG. 20.

As in the case of the building press illustrated in FIG. 1 of the drawings, individual nail plates 30 can be positioned at each juncture of truss members 29 as truss members 29 are placed in the building press 1 illustrated in FIGS. 14 and 15 of the drawings. However, referring now to FIG. 20 of the drawings, and in a preferred embodiment of the invention a pair of plate bands 66, which may be metal, plastic, or even fabric and designed to carry a plurality of nail plates 30, are wound on plate band drums 59, as illustrated. Plate band drums 59 are in turn rotatably mounted on plate band drum shafts 60, and may be configured in staggered relationship in order to facilitate stretching plate bands 66 over each layer or level of truss members 29 placed in building press 1. It will be appreciated that nail plates 30 are spaced so as to align with each of the junction points of truss members 29, as illustrated in FIG. 20, and plate bands 66 may be manually pulled from plate band drums 59 and positioned as illustrated for each level of truss members to be fabricated. Alternatively, plate bands 66 may be pre-formed into strips of desired length and placed into position on each level of truss members to be fabricated. When plate bands 66 are positioned as illustrated in FIG. 20 for each level of truss members 29 to be fabricated, the appropriate pressure means, whether it be a hose or hoses or application of fluid actuated cylinders, is activated and nail plates 30 are driven into truss members 29 to produce multiple units of the desired truss. Plate bands 66 are then cut off at the feed end nearest plate band drums 59, and the fabricated trusses are unloaded from building press 1.

Referring now to FIGS. 21 through 32 of the drawings, it will be understood that various types of fastener bands may be utilized within the scope of this invention, in both the building press 1 as characterized in FIG. 1 of the drawings, and the building press illustrated in FIGS. 14 through 20. For example, referring to FIGS. 21 and 22 of the drawings, it will be appreciated that in a preferred embodiment of the invention plate bands 66 are characterized by a substantially flexible base member or carrying band which is fitted with nail plates 30, either glued or otherwise attached to the band. This flexibility of plate band 66 permits the bands to be readily wound on plate band drums 59 and stripped from the drums in the truss-constructing operation outlined above. In a typical embodiment of the invention, nail plates 30 are formed by pressing nail plate teeth 68 from the body of each nail plate 30, forming nail plate teeth apertures 69, with nail plate teeth 68 projecting in essentially perpendicular relationship to nail plate teeth apertures 69 in order to permit proper penetration into truss members 29 when fabrication pressure is applied. In another embodiment of the invention plate band 66 may be formed of a relatively thin metal sheet such as 20 guage metal, and nail plate teeth 68 punched therefrom in the manner described above in lieu of the provision of a flexible band having nail plates 30 mounted thereon.

Figure 23:
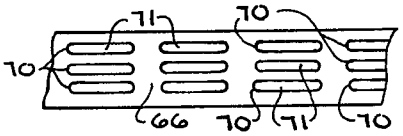
FIGS. 23 and 24 illustrate an alternative plate band for use with the building press illustrated in FIG. 1.
Figure 22:
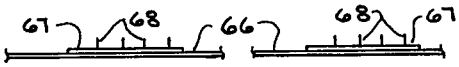
Figure 24:
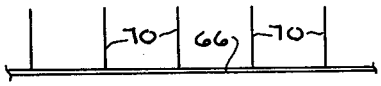

Referring now to FIGS. 23 and 24 of the drawings, in still another preferred embodiment of the invention plate bands 66 may be formed of a relatively thin metal strip of about 20 guage thickness, and having plate band teeth 70 punched therefrom into an essentially perpendicular relationship with respect to plate band 66, and to the plate band teeth apertures 71. As illustrated, the plate band teeth 70 formed by this operation are somewhat longer and thinner than the nail plate teeth 68 illustrated in FIGS. 21 and 22. Accordingly, the plate band teeth 70 are primarily designed to serve the needs of the building press illustrated in FIG. 1 of the drawing in lieu of nails 12 mounted on the flexible or semi-rigid sprocket nail band 46 as heretofore described. In order to impart maximum rigidity to nail plate teeth 70 in the punching operation, it is preferred that nail plate teeth 70 be rounded in cross section, according to processes which are well known to those skilled in the art.

Figure 25:
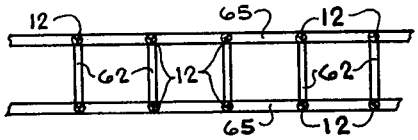
FIGS. 25–32 illustrate various configurations of nails and nail bands which may be used in operation of the building press illustrated in FIG. 1.
Figure 27:
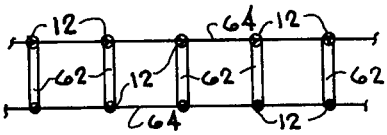
Figure 26:
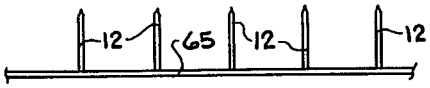
Figure 28:
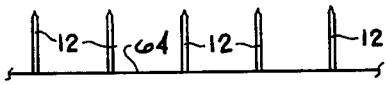

Referring now to FIGS. 25 and 26 of the drawings, it will be appreciated that in another embodiment of the invention nails 12 can be formed in a "U" shaped configuration, the legs of which are formed by nails 12 and the connecting base of the "U" formed by a nail base 62, the whole nail fastener of which can be made of a single piece of metal. These "U" shape nails 12 are preferably attached to a double ribbon nail band 65, as illustrated in FIG. 25. This configuration of nails 12 permits application of the nail band so formed to the building press 1 illustrated in FIG. 1 of the drawings. In a similar application, referring now to FIGS. 27 and 28 of the drawings, the same "U" shaped nail 12 can be applied to a double wire nail band 64 instead of the double ribbon nail band 65 illustrated in FIGS. 25 and 26. As in the case of the double ribbon nail band 65, the double wire nail band 64 can be joined to the "U" shaped nails 12 by welding, glueing, or by other techniques known to those skilled in the art, to provide a fastener which can be used in lieu of the sprocket nail band 46 illustrated in FIG. 3 of the drawings.

Figure 3:
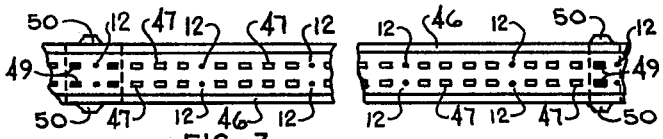
FIG. 3 is a top view, partially in section, of a sprocket nail band illustrated in FIG. 1, operable to carry nails or other fasteners to be driven into the building components.
Figure 4:
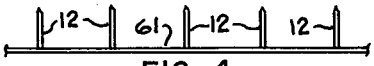
FIG. 4 is a side elevation, partially in section, of an alternative nail band or strip which can be used to locate nails at selected points in the building press.
Figure 29:
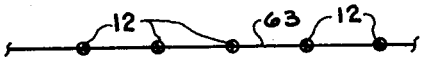
Figure 30:
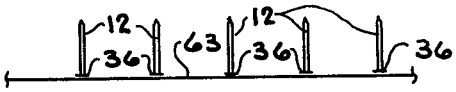

In still another preferred embodiment of the invention, and referring now to FIGS. 29 and 30 of the drawings, a single band of nails 12 can be provided by attaching the nails 12 to a wire nail band 63 as illustrated, by techniques such as welding, glueing, or other procedures known to those skilled in the art, and a double row of these fasteners can be used in lieu of the sprocket nail band illustrated in FIG. 3 of the drawings.

Figure 31:
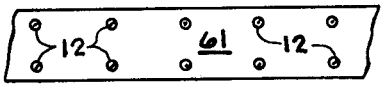
Figure 32:
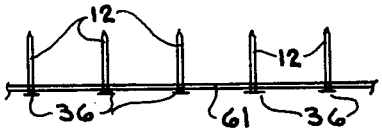

In yet another preferred embodiment of the invention, referring now to FIGS. 31 and 32, an alternative embodiment of the fixed nail band 61 is provided under circumstances where the nail band is formed of a relatively thin sheet metal strip (preferably about 20 guage) having holes therein to accommodate nails 12, which are driven through the holes with nail heads 36 projecting on the underside of the band. As in the case of the fixed nail band 61 previously described, the band can be wound on a suitable drum as illustrated in FIG. 1 of the drawings, and withdrawn from the drum across the hammer 5 and used in the same manner as above described for the building press illustrated in FIG. 1.

In operation, construction of typical wall member by application of the building press illustrated in FIGS. 1 through 3 of the drawings is as follows. A set of horizontal building components 16 and vertical building components 17 are initially placed in position on frame 2 for assembly as illustrated. A pair of nail band drums 45 carrying a sprocket nail band 46 and nails of the proper length and spacing to construct the wall section are placed on nail band drum shafts 51, and the band drive apertures 47 of sprocket nail band 46 are meshed with gear teeth 49 of drive sprocket 52 and idler sprockets 48, to properly align sprocket nail band 46 on hammers 5 and nails 12 with building components 16. When proper alignment is achieved, fluid inlet valve 15 is opened to permit hoses 7 to be pressured and force hammer 5 and nails 12 toward vertical building components 17 to drive nails 12 into building component joints 18. Pressure release fittings 14 are then manipulated to release pressure from hoses 7, and hammers 5 are then forced away from the segment of sprocket nail band 46 which is joined to each vertical building component 17 by application of hammer weights 72, or manually. Drive sprockets 52 are then activated by energizing drive motor 56, and the completed wall assembly is pulled in the direction of the arrow, as a new segment of sprocket nail band 46 and the nails 12 is pulled across hammer 5 into functional position to assemble another wall section. When the completed wall section is clear of frame 2, sprocket nail band 46 is cut and the completed section moved down the assembly line for further disposition. A new set of horizontal building components 16 and vertical building components 17 is then placed in position and the process is repeated.

Referring now to FIGS. 14 through 20 of the drawings, application of that embodiment of building press 1 which is directed to truss fabrication will be described. Front frame members 19 and rear frame members 20 are initially adjusted on adjusting frame member 21 and secured by means of adjusting holes 26 and adjusting pins 27, in order to construct a russ of selected height. A first layer of truss members 29 is then placed in building press 1 as illustrated in FIG. 15, with a set of nail plates 30, provided with fasteners upwardly and downwardly projected at each joint. Multiple layers of truss members 29 are then stacked in building press 1 as illustrated in FIG. 14, with layers of nail plates 30 therebetween at each joint segment. When all truss members 29 have been placed in the proper stacked configuration as illustrated in FIG. 14, fluid inlet valve 15 is open and a hose or hoses 7 are pressured to force the stacked truss members 29 against the top ones of front frame members 19 and rear frame members 20, as illustrated in FIG. 18 of the drawings. When each one of nail plates 30 has been securely driven into the joints between truss members 29 at each level thereof, pressure is released from hoses 7 by means of pressure release fittings 14, and hammers 5 drop back into position as illustrated in FIGS. 14 and 17. The fabricated trusses can now be easily removed from the press as desired.

In a preferred embodiment of the invention, and referring now to FIG. 20 of the drawing, instead of utilizing separate nail plates 30, the nail plates are positioned on plate bands 66, as heretofor described, and wound on a pair of plate band drums 59, as described in reference to the building press illustrated in FIG. 1 of the drawings. This permits an initial set of truss members 29 to be placed in the building press as illustrated in FIG. 20, two links of plate band 66 to be unrolled from plate band drums 59 and stretched across truss members 29, and another layer of truss members 29 to be placed on top of plate band 66. This procedure is repeated until the building press is full of truss members 29 as heretofore described, and the pressuring operation is the same as that heretofore described. When it is desired to remove the completed trusses from the building press 1 in this embodiment of the invention, it will be recognized that plate bands 66 must be severed at the end closest to plate band drums 59 in order to free the completed trusses. As is the case of the nail bands used in the building press illustrated in FIG. 1 of the drawings, plate band 66 remains attached to each respective truss along with nail plates 30.

As heretofore described, in a preferred embodiment of the invention, both the building press 1 configured as illustrated in FIG. 1 and the press shown in FIG. 14 can be operated by pressure cylinders 37, as illustrated in FIGS. 11 and 19, respectively. The pressure cylinders replace hoses 7 as the pressuring means, and may be either hydraulically or air activated according to techniques well known to those skilled in the art. Furthermore, as illustrated in FIGS. 11 and 12, pressure cylinders 37 are preferably double-action cylinders to facilitate retraction of hammers 5 after construction of a wall section, while the cylinders 37 shown in FIG. 19 are preferably single-action in operation, with hammer retraction achieved by gravity.

I claim:

1. A building press comprising:

(a) A frame shaped to receive building components in a selected configuration;

(b) A pair of oppositely disposed, continuous hammers coextensive with said frame and movably carried by said frame;

(c) Band means positioned in substantially parallel relationship between said hammers and said building components;

(d) A plurality of fasteners carried by said band means and having sharpened tips adjacent to said building components; and (e) Pressure means in cooperation with said frame and said hammers to move said hammers with respect to said frame and force said fasteners into said building components.

2. The building press of claim 1 further comprising a plurality of magnetic nail positioners adjustably carried by said hammers for selectively positioning said band means and said fasteners on said hammers.

3. The building press of claim 1 wherein said pressure means is at least one hose capable of being expanded by application of fluid pressure.

4. The building press of claim 1 further comprising a plurality of magnetic nail positioners adjustably carried by said hammers and characterized by a first set of magnets magnetically adhering to said hammers and a second set of magnets magnetically adhering to said band means, and wherein said pressure means is at least one hose capable of being expanded by appplication of fluid pressure.

5. The building press of claim 1 wherein said pressure means is at least one fluid pressure-actuated cylinder.

6. The building press of claim 1 further comprising a plurality of magnetic nail positioners adjustably carried by said hammers and characterized by a first set of magnets magnetically adhering to said hammers and a second set of magnets magnetically adhering to said band means, and wherein said pressure means is at least one fluid pressure-actuated cylinder.

7. The building press of claim 1 further comprising pulley and weight means cooperating with said frame and said hammers for retracting said hammers after said fasteners are pressed into said building components, and wherein said hammers are disposed in said frame for essentially horizontal closure; said band means is stored on a pair of drums; and said pressure means is a pair of hoses having one end closed and disposed between said hammers and said frame.

8. The building press of claim 1 wherein said hammers are disposed in said frame for essentially horizontal closure; said band means is stored on a pair of drums; said fasteners are nails having heads which are attached to said band means; said pressure means is a pair of hoses having one end closed and capable of being expanded by application of fluid pressure and disposed between said hammers and said frame; and further comprising a valve provided at the open end of said hoses for pressuring said hoses, and pulley and weight means cooperating with said frame and said hammers after said fasteners are pressed into said building components to retract said hammers.

9. The building press of claim 8 further comprising a drive sprocket rotatably mounted on one end of each of said hammers and an idler sprocket mounted on the opposite end of each of said hammers and in engagement with said band means, and drive means in cooperation with said drive sprocket to position said band means and said nails on said hammers.

10. The building press of claim 9 wherein said band is flexible and said fasteners are nails permanently attached to said band and projecting from said band in essentially parallel relationship.

11. The building press of claim 1 wherein said band is a pair of continuous wire members disposed in parallel relationship and joined at said fasteners, and said fasteners are nails carried by said wire members.

12. The building press of claim 1 wherein said frame is defined by a set of vertically oriented braces carrying a pair of vertically spaced front frame members and a pair of vertically spaced rear frame members; said hammers are disposed for vertical movement on the lower of said front frame members and on the lower of said rear frame members, respectively, responsive to said pressure means; and one of said band means is positioned on each of said hammers and between each layer of building components placed in said building press to permit fabrication of multiple trusses in a single manipulation of said hammers.

13. The building press of claim 12 further comprising swivel means in said rear frame members and in said one of said hammers positioned on the lower one of said rear frame members.

14. The building press of claim 12 further comprising adjusting members adjustably carrying said front frame members and said rear frame members to facilitate construction of multiple trusses of selected height.

15. The building press claim 12 further comprising:

(a) Swivel means in said rear frame members and in said one of said hammers positioned on the lower one of said rear frame members; and (b) Adjusting members adjustably carrying said front frame members and said rear frame members to facilitate construction of multiple trusses of selected height.

16. The building press of claim 12 wherein said pressure means is a pair of hoses disposed between the lower of said front frame members and one of said hammers and between the lower of said rear frame members and the other of said hammers to facilitate upward movement of said hammers when said hoses are subjected to fluid pressure.

17. The building press of claim 12 wherein said pressure means is at least two pressure-responsive cylinders positioned between the lower of said front frame members and one of said hammers and between the lower of said rear frame members and the other of said hammers to facilitate upward movement of said hammers when said cylinders are subjected to fluid pressure.

18. The building press of claim 12 wherein said band means is metal and said fasteners are nails permanently attached to said metal and projecting from said metal in essentially perpendicular relationship.

* * * * *